United States Patent [19]

Rorabaugh

[11] Patent Number: 4,653,749

[45] Date of Patent: Mar. 31, 1987

[54] ADJUSTABLE-RESISTANCE EXERCISE SKI-PAD

[76] Inventor: Barre L. Rorabaugh, 8839 Production Ave., San Diego, Calif. 92121

[21] Appl. No.: 695,087

[22] Filed: Jan. 25, 1985

[51] Int. Cl.[4] ..... A63B 69/18

[52] U.S. Cl. ..... 272/97; 272/70; 272/131

[58] Field of Search ..... 272/70, 69, 97, 96, 272/131, 116, 127, 134, 72; 128/25 R; 238/10 R; 104/69, 118

[56] References Cited

U.S. PATENT DOCUMENTS

| | | | |
|---|---|---|---|
| 430,808 | 6/1890 | Naish | 272/70 |
| 3,589,720 | 6/1971 | Agamian | 272/131 |
| 3,729,207 | 4/1973 | Reynolds | 272/97 |
| 4,229,001 | 10/1980 | Roman | 272/131 |
| 4,545,575 | 10/1985 | Forjot | 272/97 |

*Primary Examiner*—Richard J. Apley
*Assistant Examiner*—S. R. Crow
*Attorney, Agent, or Firm*—Robert A. Hirschfeld; James F. Duffy

[57] ABSTRACT

A ski-pad simulating skiing leg motion is captively supported on tracks, and has individually adjustable sliding friction with respect to the tracks. A handwheel, threaded shaft, saddle and scrissors linkage transmit manually applied adjustment force to friction pads coacting with track friction surfaces. The ski pad and friction adjustment mechanism are removable as a unit from the tracks. The user stands upon the ski pad, and in one embodiment, is coupled thereto by breakaway ski-bindings and ski-boots.

8 Claims, 5 Drawing Figures

ADJUSTABLE-RESISTANCE EXERCISE SKI-PAD

RELATED APPLICATION

A ski-pad rollingly captively coupled to track means but having no provision for resisting relative motion thereof is disclosed in the inventor's application Ser. No. 653,551, filed Sept. 9, 1984, entitled MULTIPLE DEVICE EXERCISE SYSTEM.

TECHNICAL FIELD

The invention relates to the field of exercise devices, and more particularly to exercise devices for simulating the leg motion of skiing.

BACKGROUND ART

In his application Ser. No. 653,551, MULTIPLE DEVICE EXERCISE SYSTEM, the inventor disclosed a unified system of various exercise devices sharing a common extruded set of parallel tracks which could be conveniently folded into a wall-mounted cabinet. One of said various exercise devices of application Ser. No. 653,551 is a rollingly captive ski-pad, typically used in pairs between adjacent sets of tracks. The person wishing to use said ski-pads for simulation of the leg motion of skiing would, as disclosed in application Ser. No. 653,551, encounter little or no mechanical resistance to the motion of the ski pads relative to the tracks, a condition which simulates only one of many possible skiing snow conditions.

Skiing snow, as is well known, can in actuality vary from slick, almost non-resistive condition, to slushy, sticky, highly motion-resistant condition, the latter condition requiring considerably more muscle exertion of an actual skiier than the former condition. One of the purposes of simulating skiing leg motion in a home or exercise-spa type exercise device is to enable skiiers to realistically build the proper muscles during non-skiing season, so that they will be more supple, prepared, and less accident prone during actual skiing.

It is sometimes important, as when recovering from an injury to one leg, that a person seeking to perform a skiing-simulation exercise be able to impose motion resistance on one leg which differs from the motion resistance imposed on the other leg. It is also desirable, but not provided by prior art ski-pads, to continuously vary the degree of motion resistance from zero or minimum to a maximum degree. In a ski-pad intended for use with a universal or multiple-device type of system such as that disclosed in said application Ser. No. 653,551, it is also important that the resistance adjustment means be self-contained, so far as possible, within the ski-pad, so as to reduce the complexity and difficulty of changing from ski-simulation to another form of exercise upon the universal structure.

Therefore, it is an object of the present invention to provide a ski-pad having adjustable motion resistance.

It is a further object of the present invention to provide a ski-pad wherein motion resistance is continuously variable.

Another object of the invention is to provide a ski-pad which, when used in pairs, provides independent motion resistance adjustment for each ski-pad of the pair.

A further object of the invention is to provide a ski-pad wherein motion resistance means and adjustment means for same are self-contained within the ski-pad.

Still another object of the invention is to provide a ski-pad which is compatible with a universal track-type exercise system.

Yet another object of the invention is to provide a ski-pad wherein worn motion-resistant material may easily be replaced.

A still further object of the invention is to provide enhanced realism in ski-simulation by breakaway attachability of conventional ski-boots to the ski-pad.

DISCLOSURE OF THE INVENTION

The invention is an improvement in ski-pads coactive with tracks. Captive engagement of the ski-pad to the track is achieved by sliders or rollers within one or more longitudinal track cavities. A portion of the track adjacent the engagement portion provides a longitudinal friction surface. One or more friction pads coupled to the ski-pad provide sliding resistance between the ski-pad and the track's friction surface. In a preferred embodiment, a handwheel having a threaded shaft is manually adjusted, the threaded shaft pressing according to the degree of manual adjustment upon a pressure linkage, which pressure linkage in turn translates force from the handwheel-adjusted threaded shaft into force urging the friction pad against the track's friction surface.

As disclosed herein, the handwheel, threaded shaft, pressure linkage and friction pad are coupled to the ski-pad, and therefore may be easily removed as a unit as part of the ski-pad when changing the track usage to some form of exercise other than skiing simulation.

In one embodiment of the invention, the user stands upon flat foot-engagement surfaces of respective ski-pads. In another embodiment, conventional breakaway ski-bindings are employed as foot-engagement surfaces, and the user wears conventional ski-boots, releasably coupled thereto. Breakaway engagement provides safety in the event the boot-wearing user loses balance while coupled to the ski-pads.

The friction pad is replaceably detachable, to facilitate individual friction pad replacement when excessively worn.

Although the preferred embodiment employs three parallel tracks, with each of a pair of ski-pads coactive with the center track, other track dispositions are within the contemplated scope of the present invention, as are track-engagement means alternative to the longitudinal-cavity structure shown, such as track-engagement which exteriorly grasps a track and is thereby held captive to the track.

BEST MODE FOR CARRYING OUT THE INVENTION

Figure 1:
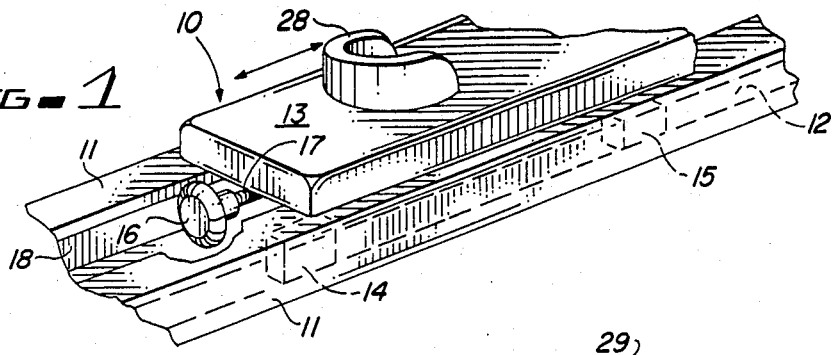
FIG. 1 is a perspective view of the invention showing an embodiment employing sliding-block track engagement, and further illustrating a breakaway ski-boot binder.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates an embodiment of the invention, generally referred to by number 10, foot coupling means 13 supported upon a plurality of captive slides 14 (only one captive slide 14 is shown in FIG. 1, for clarity) captive to tracks 11. Friction pad 15 , operation of which is more fully shown in subsequent-numbered figures, engages friction surface 12 of track 11. The degree of friction between friction pad 15 and friction surface 12 is manually adjustable by the user, by turning handwheel 16 upon threaded shaft 17, as is hereinafter described. Captive slide 18 in the embodiment of FIG. 1 is held within longitudinal cavity 18 of track 11.

Figure 2:
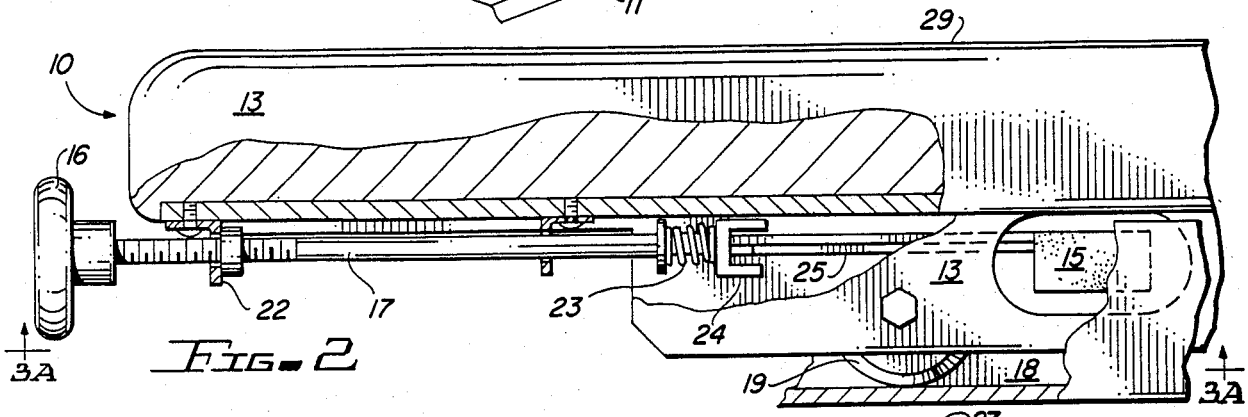
FIG. 2 is a cutaway side elevational view of an embodiment of the invention having captive roller track engagement.
Figure 3A:
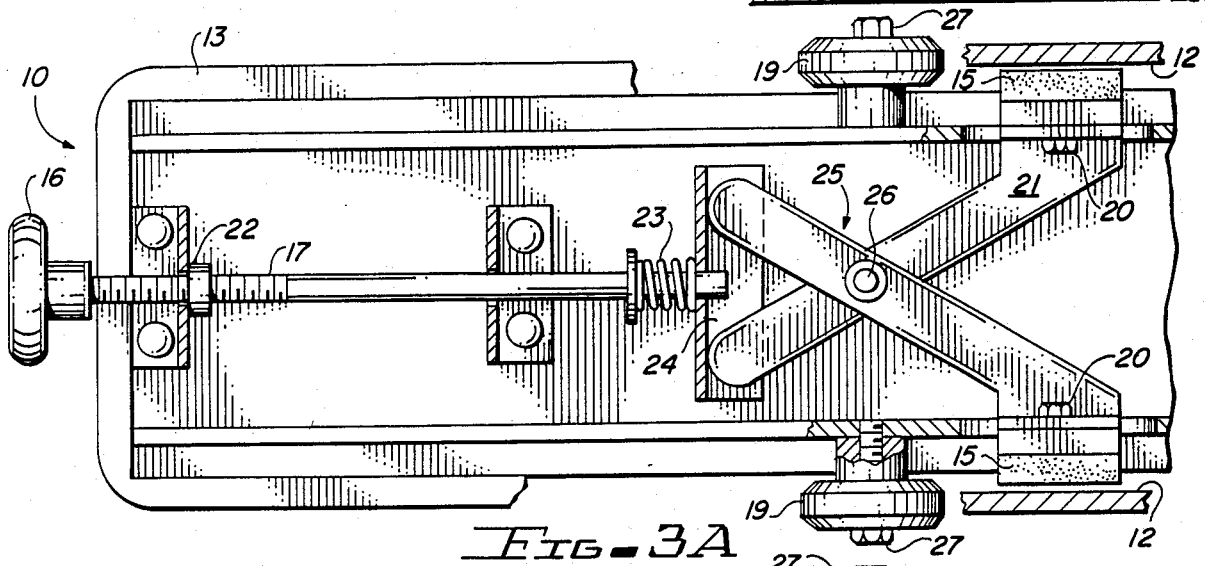
FIG. 3A is a bottom cutaway view of the invention of FIG. 2 showing friction pads disegaged from the track friction surface.
Figure 3B:
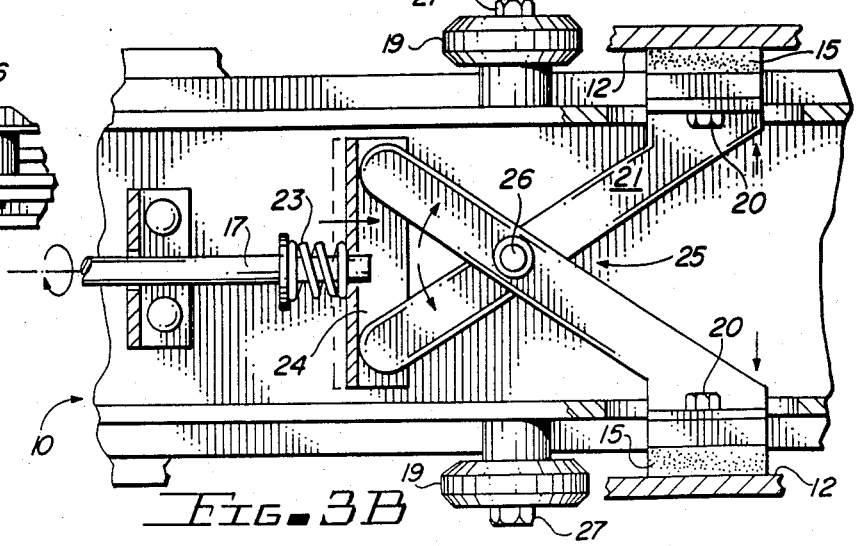
FIG. 3B is a bottom view similar to FIG. 3A, showing friction pads engaged with the track friction surface.

FIGS. 2, 3A and 3B show an embodiment of the invention having captive roller track engagement means 19 within longitudinal cavities 18 in tracks 11. Captive rollers 19 are threadedly attached to foot coupling means 13 by captive roller axles 27, rollers 19 freely rotatable about axles 27. Handwheel 16 is manually adjusted by the user to threadedly rotate threaded shaft 17 with respect to threaded coupling 22. Alternatively, threaded shaft 17 may be threadedly engaged directly with a portion of foot coupling 13. Force from threaded shaft 17 is transmitted through shock absorbing coupling 23 to pressure linkage saddle 24, and thence through scissors linkage, pivoted by scissors pivot 26, to outwardly urge friction pads 15 against friction surface 12 of track 11.

FIG. 3A shows the pressure linkage, generally referred to as 21, in retracted position, with friction pads 15 disengaged from friction surfaces 12.

FIG. 3A shows pressure linkage 21 pressing friction pads 15 against friction surfaces 12. A gradual variation from zero or minimum sliding friction between pads 15 and surfaces 12, to a maximum, is conveniently afforded the user by rotation of handwheel 16. At maximum tightness, said degree of friction may be used to effectively lock the ski-pad into fixed position for transport of the entire exercise system, or for use of the ski-pad for fixed support purposes, such as a portion of a fixed seat. Flat surface 29 is shown upon foot-coupling means 13.

Friction pads 15 are coupled to scissors linkage 15 by nut-and-threaded-stud pad replacement means 20. Alternatively, spring clips and other pad relacement means may be employed. Pads 15 may therefore be replaced when excessively worn, without disassembling the entire ski-pad 10.

Figure 4:
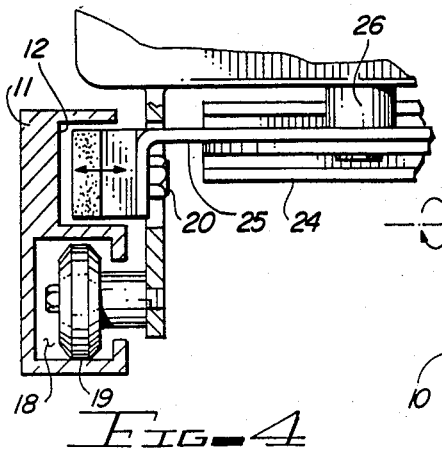
FIG. 4 is an enlarged partial end view of the invention of FIG. 2 , showing friction pad engagement ith a portion of track adjacent a longitudinal track cavity containing a captive roller.

FIG. 4 more clearly shows, in end view, captive roller means 19 held captive within longitudinal cavity 18 of track 11. Friction surface 12 is shown above and adjacent cavity 18, and relative positions of pad replacement means 20, pressure linkage saddle 24 and scissors pivot 26 are more clearly illustrated.

What has been disclosed is an improved ski-pad having adjustable sliding friction relative to tracks to which the ski-pad is captive. Replaceable friction pads are urged into adjustable amount of friction with longitudinal friction surfaces upon the tracks, by a scissors-type pressure linkage, displaced by a saddle coupled by shock absorbing coupling to a threaded shaft, manually turned by the user. Captive engagement to the tracks is provided by sliding blocks, captive wheels and the like.

The entire friction adjusting assembly is removable as part of the ski-pad, as a unit, facilitating repair and adjustment, as well as transformation of the tracks to a use other than for skiing similation.

Foot engagement may be by standing upon the flat foot coupling surface, or in another embodiment, by coupling ski-boots worn by the user to breakaway ski-bindings attached to the foot-coupling means.

As defined herein, pressure linkage 21 comprises force translation means.

Those skilled in the art will conceive of other embodiments of the invention which may be drawn from the disclosure herein. To the extent that such other embodiments are so drawn, it is intended that they shall fall within the ambit of protection provided by the claims herein.

Having described my invention in the foregoing description and drawings in such a clear and concise manner that those skilled in the art may readily understand and practice the invention, that which I claim is:

1. An adjustable-resistance exercise ski-pad comprising:

track means having friction surface means;

ski-pad means having foot coupling means;

track-engagement means coupled to said ski-pad means, said track-engagement means moveably captive to said track means for moveably supporting said ski-pad means upon said track means;

friction pad means coupled to said ski-pad means, said friction pad means slidingly engaged with said friction surface means;

friction adjustment means coupled to said ski-pad means and to said friction pad means for varying frictional resistance between said ski-pad means and said friction surface means of said track means, said friction adjustment means comprising pressure linkage means, said pressure linkage means having manual adjustment means for manually adjusting the extent by which said friction pad means is slidingly coupled to said friction surface means, said manual adjustment means comprising handwheel means having threaded shaft means, said threaded shaft means threadably coupled to said ski-pad means, said threaded shaft means coupled to said pressure linkage means, said pressure linkage means having force translation means for translating force from said threaded shaft means into force urging said friction pad means into frictional coaction with said friction surface means.

2. The adjustable-resistance exercise ski-pad of claim 1 wherein said track means comprises at least two parallel tracks in spaced relationship, said ski-pad means intermediate a pair of said parallel tracks.

3. The adjustable-resistance exercise ski-pad of claim 1 wherein said friction surface means is exteriorly adjacent said longitudinal cavity means.

4. The adjustable-resistance exercise ski-pad of claim 1 wherein said track-engagement means comprises captive roller means, said captive roller means having axle means, said axle means coupled to said ski-pad means, said captive roller means rollingly captive to said track means.

5. The adjustable-resistance exercise ski-pad of claim 4 wherein said track means has longitudinal cavity means, said captive roller means rollingly captive within said longitudinal cavity means.

6. The adjustable-resistance exercise ski-pad of claim 5 wherein said friction surface means is exteriorly adjacent said longitudinal cavity means.

7. The adjustable-resistance exercise ski-pad of claim 1 wherein said friction pad means has replaceable detachment means for renewable replacement of said friction pad means when excessively worn.

8. The adjustable-resistance exercise ski-pad of claim 1 wherein said foot coupling means comprises a flat surface for emplacement of feet in simulation of skiing motion.

* * * * *